United States Patent [19]

Griffin

[11] Patent Number: 4,724,871

[45] Date of Patent: Feb. 16, 1988

[54] PLASTIC FITTING SPACER

[75] Inventor: Gary E. Griffin, Penn Yan, N.Y.

[73] Assignee: Parker Hannifin Corporation, Cleveland, Ohio

[21] Appl. No.: 880,383

[22] Filed: Jun. 30, 1986

[51] Int. Cl.[4] ..... F16L 55/00

[52] U.S. Cl. ..... 138/109; 138/45; 138/108; 138/113; 138/148; 206/418

[58] Field of Search ..... 138/45, 96 R, 96 T, 138/103, 109, 108, 113, 148; 206/418

[56] References Cited

U.S. PATENT DOCUMENTS

| | | | |
|---|---|---|---|
| 4,313,471 | 2/1982 | Lissau | 138/45 |
| 4,592,390 | 6/1986 | Boyd | 138/45 |

FOREIGN PATENT DOCUMENTS

| | | | |
|---|---|---|---|
| 559207 | 9/1923 | France | 206/418 |
| 512116 | 8/1939 | United Kingdom | 206/418 |
| 611180 | 10/1948 | United Kingdom | 206/418 |

*Primary Examiner*—James E. Bryant, III

*Attorney, Agent, or Firm*—Joseph B. Balazs

[57] ABSTRACT

A protective spacer for fittings and the like consists of tubular plastic body member with a transverse end wall having a plurality of radiating slits therein forming plural gripper tabs. The body member is formed of thermoplastic material and the tabs are resiliently deformable into a tunnel configuration adapted to receive a portion of a fitting member and to be self-supported thereon. The spacer provides radial spacing from the thus supported fitting portion and axial spacing for opposed structures in abutment with the transverse end wall and free end of the body member.

3 Claims, 5 Drawing Figures

PLASTIC FITTING SPACER

BACKGROUND OF THE INVENTION

This invention relates to protective devices and more particularly to a fitting protector or spacer especially for structures which are suited for transport in cardboard boxes and the like.

In the packaging and shipment of filter-driers for refrigeration equipment for example, such devices are typically placed in a cardboard container for delivery or warehousing purposes. Such filter-driers are tubular structures and often have axially exposed threaded fittings thereon which require protection from axial shifting within the container and consequent damaging abutment with adjacent units or other structures. These devices are usually packaged in a container having fold-in flaps at either end which engage the fittings on the filter-drier and provide a support therefore. Such containers are, however, relatively expensive and inconvenient to load under mass production techniques wherein engagement must be made between an opening in the container flap and the component in the carton, before the end flap can be closed. An example of such prior art is depicted in U.S. Pat. No. 2,537,151 in relation to the packaging of vacuum tubes.

Other forms of thread or fitting protectors or spacers have been utilized for similar purposes and often constitute a tubular-like device which can be slipped over threads or a portion of a fitting or container or the like. For economy, ease of fabrication and use such devices are quite simplified and usually comprise minimal components which are effective to serve the purpose. Examples of such devices are shown in U.S. Pat. Nos. 4,501,301, 4,033,380 and 3,840,052. The two later patents describe similar tubular structures with transverse end walls and specific devices for engagement of the threads or the like. The earlier patent is a simplified tubular structure with or without an end wall which relies on a concave wall structure for gripping support. None of these prior art devices are particularly well suited for the gripping or irregularly shaped parts of various sized wherein both radial and axial spacing is obtained.

SUMMARY OF THE INVENTION

The instant invention obviates many of these problems in a simplified structure wherein both radial and axial spacing is achieved and wherein accommodation is made for the gripping of irregularly shaped, variously sized objects. Further, it is well suited to the shipping carton application wherein the spacer must be positioned on an object to be protected as the object is placed in the carton. The protective spacer of the invention comprises a plastic tubular housing having a transverse end wall which is slit in a star pattern to provide a plurality of angularly spaced, generally triangular tabs. The protective spacer is pressed in place over the fitting at either end of a filter-drier, for example, to engage wrench flats on the fitting and to urge the tabs to a deformed position generally parallel to one another and parallel to the tubular side wall. The protective spacer is formed or resilient plastic so that the tabs are thus flexed into a tunnel like configuration with a bias urging the tabs to their normal position in the end wall. The bias thus creates a gripping force to secure the protective device on the fitting. In this arrangement, each end wall engages one side of the filter-drier so that the free end of the spacer may be sized to be closely adjacent to the closed flap of the carton, thereby preventing any axial shifting therein.

DETAILED DESCRIPTION OF THE INVENTION

Figure 1:
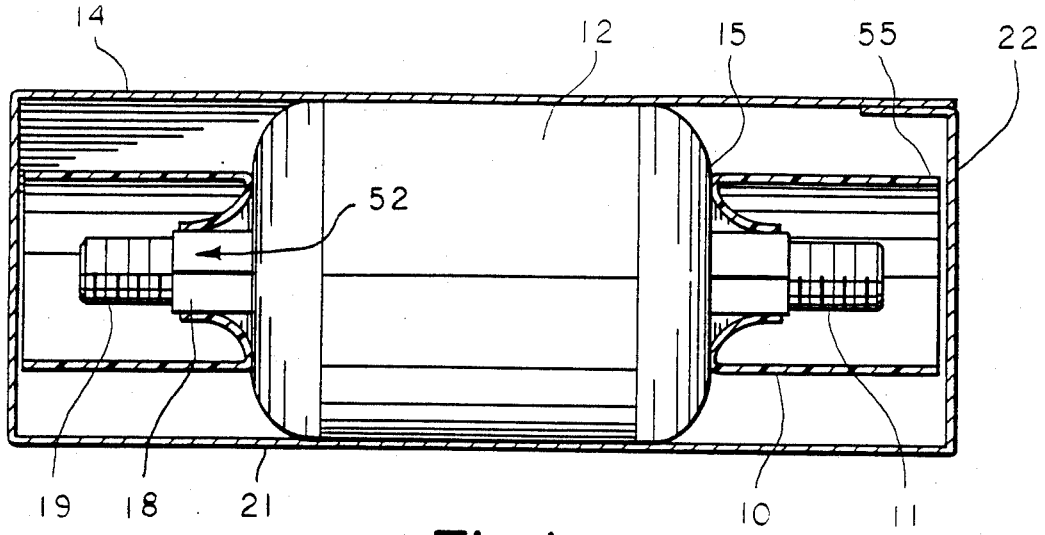
FIG. 1 is an elevational view, partly in section, of a filter drier for refrigeration purposes disposed in a cardboard carton, with a pair of protective spacers of the invention disposed on end fittings of the filter drier.

Referring now to the drawings, there is shown in FIG. 1 a pair of protective spacers 10 of the invention disposed in position on the end fittings 11 of a filter drier 12 with the assembly disposed in a cardboard container 14. The filter drier 12 is one example of device suitable for the teachings of this invention as is container 14. The protective spacer may as well be used solely as a thread protector for threaded members such as pipes. Filter drier 12 is a cylindrical member having a pair of flat, parallel end surfaces 15 on which are disposed end fittings 11, end projecting axially outwardly of filter drier 12. Each end fitting 11 in this example comprises a hexagonally shaped wrench flat section 18 adjacent filter drier 12, and a further outwardly extending threaded portion 19. Wrench flat section 18 comprises six sides in the hexagonal, parallel disposition with all of the sides parallel to the axis of filter drier 12. Container 14 is a conventional cardboard box utilized to house and ship filter drier 12 and is generally of typical square section having 4 parallel sides 21 and folded in end flaps 22.

Container 14 is sized so that sides 21 thereof are spaced closely adjacent the periphery of filter drier 12 and thereby support it within the package. The length of sides 21, however, are somewhat longer than the overall length of filter drier 12, to accommodate variations in end fittings 11, length of threaded portion 19, and the like. In such arrangement filter drier 12 is relatively free to shift axially and to incur damage to end fittings 11 or to burst the container 14.

Figure 2:
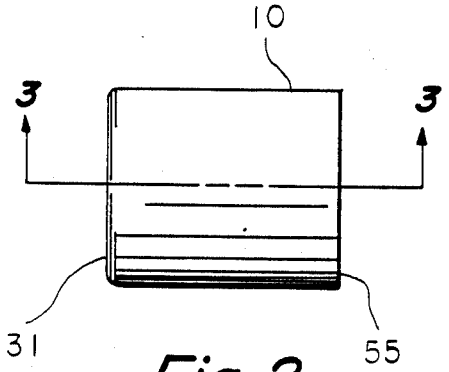
FIG. 2 is an elevational view of the protective spacer of the invention.
Figure 3:
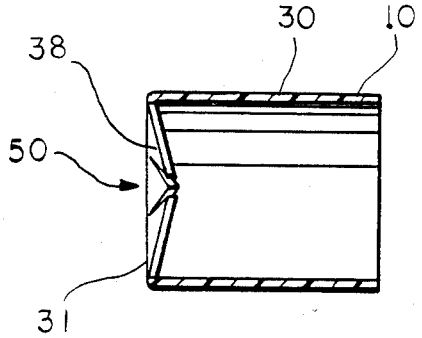
FIG. 3 is a sectional view of the protective spacer of FIG. 2, taken along the lines 3—3.
Figure 4:
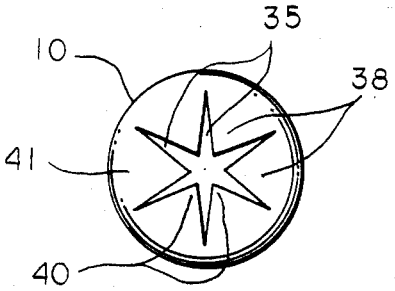
FIG. 4 is an end view of the protective spacers of FIG. 2.

To stabilize filter drier 12 within container 14 and to prevent such damage, protective spacers 10 are provided at each end of filter drier 12. Each protective spacer 10 comprises, as best seen in FIGS. 2–4, a body member having a tubular portion 30 and an integral transverse end wall 31 contiguous with tubular portion 30. Protective spacer 10 is formed of polyethylene or similar resilient plastic material which provides sufficient rigidity to retain its shape and is resilient and temporarily deformable to another configuration.

The end wall 31 of each protective spacer 10 includes a plurality of slits 35 radiating outwardly from the center of end wall 31 in a star shaped pattern. Each slit 35 extends from the center of end wall 31 radially outwardly to a location about midway between the center and the periphery of end wall 31. Adjacent slits 35 thus form triangularly shaped tabs 38 therebetween with each tab 38 having an apex 40 at the center of end wall 31 and a base 41 generally at the location at the outer ends of adjacent slits 35.

Figure 5:
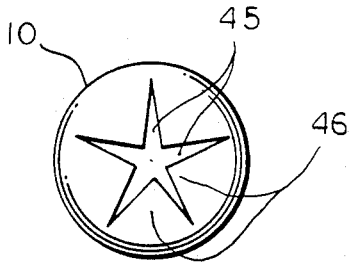
FIG. 5 is an end view of a second embodiment of protective spacer.

In the preferred embodiment of the invention six slits 35 are provided, each equally angularly spaced to provide identical tabs 38. In another embodiment of the invention seen in FIG. 5, five slits 45 are provided, again, equally angularly spaced and dimensioned similar to that shown in FIG. 4. The five slits 45 produce five tabs 46 and it will become apparent that similar results obtain from the second or other embodiments of the invention.

The six tab 38 configuration of protective spacer 10 is preferred in cooperation with the hexagonal wrench flat portion 18 of filter drier 12. As seen in FIG. 3, tabs 38 of end wall 31 normally lie in a slightly folded-in disposition within tubular portion 30 due to a natural inward puckering of end wall 31, thereby forming a small opening 50 at the center of all tabs 38. As protective spacer is placed over fitting 11, tabs 38 will be further deflected inwardly into tubular section 30, initially by threaded portion 19, and then by wrench flats 18. As protective spacer is fully positioned on fitting 11 with end wall 31 in engagement with end surface 15 of filter drier 12, tabs 38 will be folded into close adjacency with the sides forming wrench flats 18, thereby forming a tunnel 52. In this configuration of tunnel 52, tabs 38 will be substantially parallel with one another and parallel with the peripheral surface of tubular section 30, with each tab 38 in engagement with one of the wrench flats 18.

The resilience of the material forming protective spacer 10 will provide a bias to tabs 38 in the deflected position shown in FIG. 1, urging tabs 38 to the normal disposition depicted in FIG. 3. This bias thus assures that tabs 38 will act as gripping fingers sufficient to support protective spacer 10 on fitting 11, with tubular portion 30 extending axially outwardly from filter drier 12. Spacers 10 are sized to fully cover fitting 11 and extend so that their free ends 55 are closely adjacent end flap 22 of container 14, thereby preventing axial shifting of filter drier 12. Spacer 10 is also radially spaced in this manner from both threads 19 and wrench flats 18 of fitting 11 to provide radial protection. However, it is apparent that in this construction, tabs 38 could engage threads 19 or other different sized structures and provide a similar supportive engagement. Further, although the six tab 38 arrangement is preferred in this embodiment, the five tabs 46 arrangement of FIG. 5 will serve substantially as well. The five tabs 46, when deflected, form a similar tunnel to that of tunnel 52, and will serve to position such spacer in a substantially coaxial manner even on a hexagonal wrench flat portion 18. Preferably as well side wall 31 of spacer 10 is of substantially the same thickness as that of tubular wall portion 30, and is readily fabricated in a single molding operation.

I claim:

1. A resilient, thermoplastic, self-supporting protective spacer for fittings and the like, comprising a body member of substantially uniform wall thickness having a tubular wall surface and adapted for mounting on said fitting, said tubular wall surface being only slightly larger than said fitting to provide radial spacing therefrom and being longer than said fitting to axially fully cover said fitting, a circular transverse end wall at one end of said body member contiguous with said tubular wall surface, said end wall having a plurality of equally angularly spaced slits therein radiating outwardly from the center of said end wall forming a plurality of identical triangular tabs, said tabs having bases near the periphery of said end wall, apexes closely adjacent the center of said end wall, and triangular outer wall surfaces between said respective bases and apexes, said tabs being resiliently deformable to positions within said body member wherein at least a portion of said outer wall surfaces of all of said tabs are substantially parallel to one another and to said tubular wall surface thereby forming a tunnel adapted for receipt and forceful engagement with a portion of said fitting, said tunnel being axially shorter than said tubular wall surface, the free end of said tubular wall surface being engageable with an opposed structure to provide a predetermined spacing between said fitting and said structure.

2. The protective spacer according to claim 1 wherein said body member is formed of polyethylene.

3. The protective spacer according to claim 1 wherein said tunnel is expandable upon said fitting to different dimensions without excessive interference forces.

* * * * *